US005247184A

United States Patent [19]

Kimball

[11] Patent Number: 5,247,184

[45] Date of Patent: Sep. 21, 1993

[54] PHOTOELECTRIC BOBBIN SENSOR WITH RETROREFLECTIVE FILAMENT PRESENCE DETECTION

[75] Inventor: Mark E. Kimball, Belchertown, Mass.

[73] Assignee: Wardwell Braiding Machine Company, Central Falls, R.I.

[21] Appl. No.: 863,202

[22] Filed: Apr. 3, 1992

[51] Int. Cl.[5] ..... G01N 21/86

[52] U.S. Cl. ..... 250/561; 139/273 A

[58] Field of Search ..... 250/561, 571, 223 R, 250/563; 356/237, 429; 139/273 A

[56] References Cited

U.S. PATENT DOCUMENTS

| | | | |
|---|---|---|---|
| 3,158,852 | 11/1964 | Schacher | 340/259 |
| 3,631,901 | 1/1972 | Langenbach et al. | 250/563 |
| 3,777,168 | 12/1973 | Sansone | 139/273 A |
| 3,887,284 | 6/1975 | Gender et al. | 250/223 B |
| 3,892,492 | 7/1975 | Eichenberger | 356/199 |
| 4,023,599 | 5/1977 | Zeleny | 139/370.2 |
| 4,221,242 | 9/1980 | Eichenberger | 139/273 A |
| 4,276,910 | 7/1981 | Eichenberger | 139/273 |
| 4,341,958 | 7/1982 | Ohsawa | 250/561 |
| 4,365,654 | 12/1982 | Viniczay et al. | 139/370.2 |
| 4,753,149 | 6/1988 | Celani | 87/29 |

*Primary Examiner*—David C. Nelms

*Attorney, Agent, or Firm*—Salter, Michaelson & Benson

[57] ABSTRACT

Photoelectric sensing apparatus is operative for sensing the absence of filament at a particular point on a supply bobbin wherein several strands of filament will still be present on the bobbin. The sensing apparatus includes a light source which directs an angled photoelectric beam at a sensing point near the center of the bobbin and a light sensor which detects reverse reflections of the beam. If there is filament present at the sensing point, the beam will reversely defect off the round surface of the filament back to the light sensor. If there is no filament present at the sensing point, the beam deflects off the exposed core of the bobbin away from the light sensor in a different direction. Electronics means are provided which cooperate with the sensing apparatus to automatically shut-down the machine pursuant to absence of filament at said sensing point.

11 Claims, 2 Drawing Sheets

PHOTOELECTRIC BOBBIN SENSOR WITH RETROREFLECTIVE FILAMENT PRESENCE DETECTION

BACKGROUND OF THE INVENTION

The instant invention relates to sensing devices and more particularly relates to photoelectric sensor apparatus for sensing the absence of filament on the supply bobbins of machinery, such as braiding machines, knitting machines and the like.

Photoelectric, opto-electric and mechanical filament sensors for machines have heretofore been known in the art. For convenience, the term filament is used herein to include generically similar materials such as natural or synthetic yarn, cord, string, wire, etc. Filament sensors are used in various types of textile machines to detect the presence or absence of a filament as it passes through a particular part of the machine so that the machine may be shut-down when there is no longer any filament available on one of the supply bobbins or where there is a break in the filament. Mechanical sensing means have previously been known whereby when a bobbin becomes empty, braking means are operated for stopping the machine. The problem with these mechanical sensing means is that they are conventionally triggered by the terminal end of the filament breaking free from the bobbin, which causes the filament to become snarled into what is known as a "rats nest", which takes time and expense to untangle before the machine can again operate.

The U.S. Pat. Nos. 3,158,852 to Schacher; 4,023,599 to Zeleny; 4,341,958 to Ohsawa; 4,365,654 to Viniczay et al; and 4,753,149 to Celani are illustrative of the various photoelectric and opto-electric filament sensors that have heretofore been known in the art. The patents to Schacher, Ohsawa, Viniczay et al and Celani teach the use of photoelectric sensors which are operable for detecting the presence or absence of filament which is passing continuously through a given region in a textile machine. The sensors output a signal to operate a warning light or buzzer, or to stop the operation of the machine when thread is absent. The Zeleny patent teaches an opto-electronic weft yarn detector for a weaving machine. The detector passes radiation across the path of the yarn onto radiation detectors to sense if the yarn is being supplied correctly. If a problem in the supply of yarn is detected, the detector emits a signal to shut-down the machine or to signal a warning buzzer or light. It has been found that these types of detectors also suffer from the same tangling problem associated with mechanical sensors because the terminal end of the filament breaks free from the bobbin and forms a tangle before the machine is shut-down.

Filament sensors are of particular importance in braiding machines wherein a plurality of bobbins constantly spin around the axis of the machine while spinning around their own axis. Because of the multitude of filaments, and the manner in which these machines operate, it is difficult to employ filament sensors. In this regard, there have been known in the art photoelectric bobbin feelers which respond when a supply bobbin becomes empty in which event the machine is stopped. Two examples of photoelectric bobbin feelers are described in the U.S. Pat. Nos. 3,892,492 and 4,276,910 to Eichenberger, wherein one or more light sources direct light onto the core of the bobbins, and one or more photoelectric sensors are utilized to discriminate between the different patterns of diffuse and specular light which are reflected off of the surface of the full and empty bobbins. There have been distinct problems however, in adjusting these types of sensors to the many different patterns of light reflected from different types of bobbins and different types of filament windings. Because of these problems, the heretofore available photoelectric bobbin feelers have not been found to be totally satisfactory.

SUMMARY OF THE INVENTION

The instant invention provides photoelectric sensing apparatus for sensing the absence of filament at a particular point on a supply bobbin rotating in a braiding machine wherein in normal practice there will still be several turns of filament left on the bobbin so that the operation of the braiding machine can be shut-down before the filament is completely unwound therefrom and breaks away. Briefly, the sensor apparatus comprises a photoelectric trigger sensor, a photoelectric reset sensor, and a logic control module. Each of the sensors direct a photoelectric beam to the rotating bobbins as they pass by the location in the machine where the sensors are mounted. As the bobbins pass through the path of the trigger beam, the trigger sensor operates whether or not the bobbin has filament thereon. The reset beam, which is located just slightly downstream from the trigger sensor, directs its beam at an angle to a sensing point near the middle of each passing bobbin. If there is filament present on the bobbin when it passes through the reset beam, the beam reversely reflects off the rounded surface of the filaments, and the sensor operates to output a signal. If there is no filament present, the reset beam deflects away off the exposed core of the bobbin. The sensors are connected to a control module which measures the timing relationship between the output signals received from the sensors. More specifically, the rotating bobbin first passes under the trigger beam wherein a timing function is started in the control module. The bobbin then passes under the reset beam. If the reset sensor operates (indicating the presence of filament on the bobbin) within a predetermined time, the control module cancels the timing function and the machine continues to operate. If, on the other hand, no filament is detected, the reset sensor does not operate, and the control module, after said predetermined time, outputs a shut-down signal to halt the operation of the machine. The timing function takes into account the time lag between adjacent bobbins so that the apparatus can operate to monitor all the bobbins as they pass through the sensor beams.

Accordingly, it is an object of the instant invention to provide a sensor for sensing the absence of filament at a particular point on a supply bobbin of a braiding machine or the like wherein when the sensor is triggered, there will still be several turns of filament left on the bobbin.

It is another object to provide a sensor which directs a photoelectric beam at an angle to the bobbin and detects a reverse reflection of light from the surface of the filament wound on the bobbin.

It is a further object to provide a sensor which is operable for monitoring a plurality of rotating bobbins as they pass around the axis of a braiding machine.

It is still another object to provide a bobbin sensor which is operable for outputting an electronic signal when no filament is detected on the bobbin, which signal causes the machine to shut-down.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIGS. 3 and 4 are additional schematic views of the sensor apparatus illustrating the positions of the trigger and reset sensors relative to each other and relative to a bobbin as the latter passes beneath the sensor while moving in its orbital path around the axis of a braiding machine or the like.

DESCRIPTION OF THE INVENTION

Figure 1:
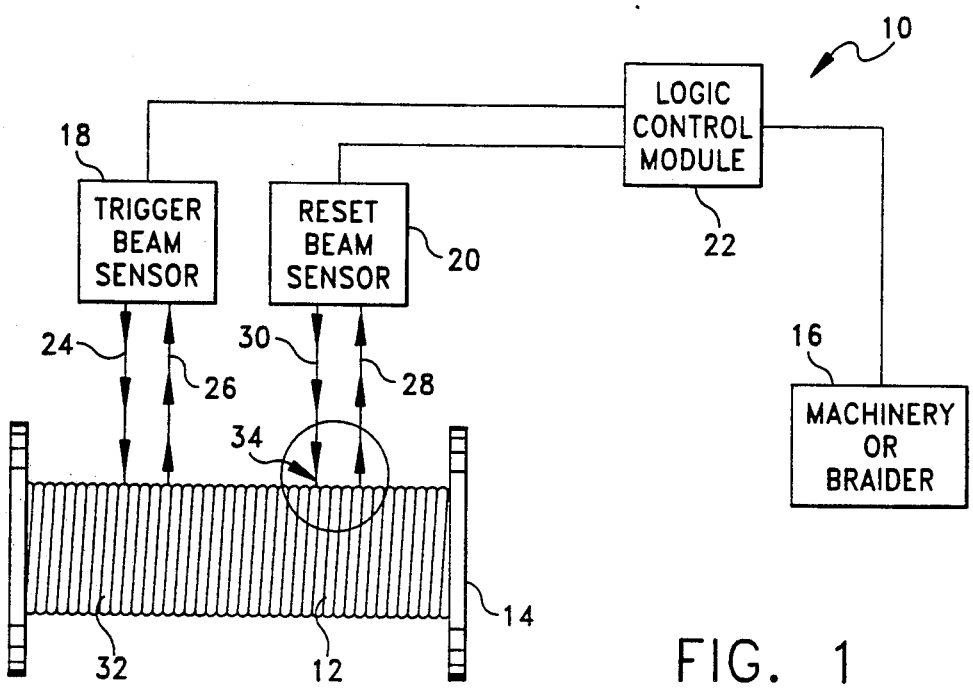
FIG. 1 is a schematic view of the sensor apparatus of the instant invention with the photoelectric beams thereof reflecting off a supply bobbin having filament wound around the core thereof.
Figure 2:
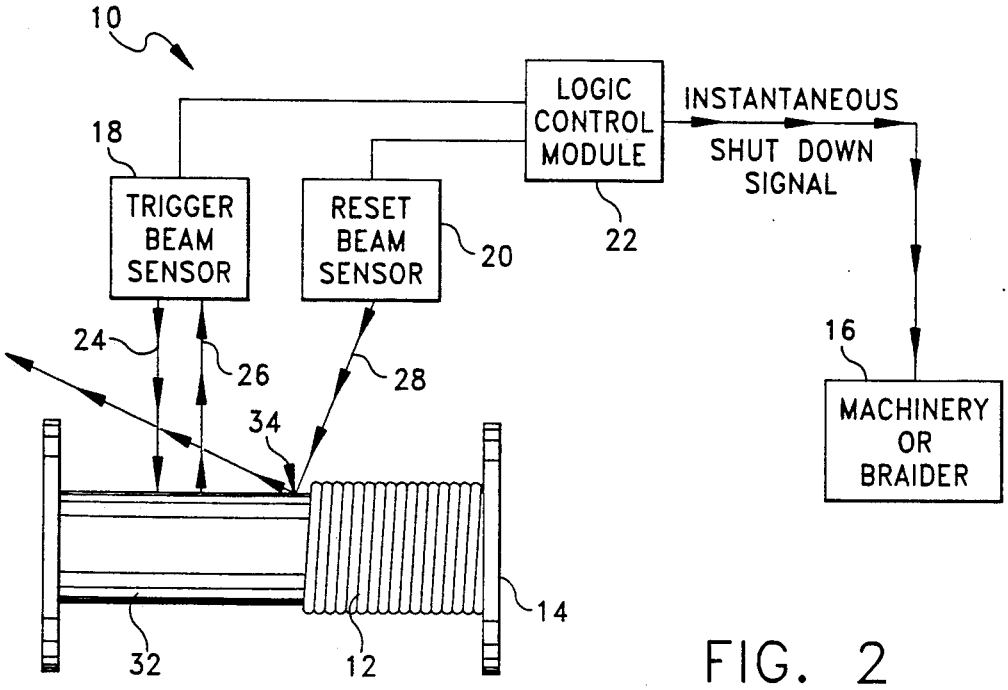
FIG. 2 is a schematic view of the sensor apparatus similar to FIG. 1 but with the supply bobbin in its "empty" mode.

Referring now to the drawings, and particularly to FIGS. 1 and 2, the sensor apparatus of the instant invention is illustrated and is generally indicated at 10. The sensor apparatus 10 is operative for sensing the absence of a substantially round cross-section filament 12 at a particular point on a rotating supply bobbin 14 moving in an orbital path around the axis of a braiding machine 16 or the like wherein when the sensing takes place, there will still be several turns of filament left on the bobbin, so that the operation of the machinery may be shut-down before the filament breaks away from the bobbin 14. It is pointed out that the filament 12 has a substantially round surface in cross-section such as found on a wire, nylon cord, coated yarn, fiberglass thread, or the like. The braiding machine 16 comprises conventional rotary braiding apparatus which includes a plurality of supply bobbins 14 which move in an orbital path around the axis of the machine 16 while at the same time spinning around their own axis. The apparatus 10 comprises a photoelectric trigger sensor 18, a photoelectric reset sensor 20, and a logic control module 22, and it effectively senses the absence of filament 12 on a bobbin 14 at a selected location on the bobbin, preferably adjacent the mid-point thereof, as the rotating bobbin moves in its orbital path in the machine 16, so that as the filament 12 unwinds and becomes nearly depleted, (FIG. 2) the operation of the braiding machine 14 can be interrupted before the filament 12 completely unwinds and breaks away from the bobbin 12 so as to create a snarl or "rats nest" which must be untangled before the machine can again operate, a difficult and time consuming chore.

Figure 1A:
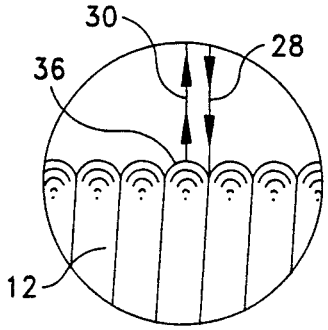
FIG. 1*a* is an enlarged view of the wound filament of FIG. 1 showing the angled photoelectric beam of the reset sensor reversely reflecting off the rounded surface of the filament.

The trigger sensor 18 includes a light source for directing a photoelectric beam 24 at the bobbin 14, and a light sensor for detecting a reverse reflection 26 of the beam 24. The sensor 18 operates to output a signal when a reverse reflection is detected, which will happen whenever a bobbin passes beneath beam 24, whether or not any filament is present on the bobbin. The reset sensor 20 also includes a light source for directing a second photoelectric beam 28 at the bobbin 14, and a light sensor for detecting a reverse reflection 30 of the beam 28, and it also operates to output a signal when a reverse reflection is detected. The trigger beam 24 is directed perpendicular to the longitudinal axis of the core 32 of the bobbin 14 and reversely reflects off the bobbin 14 whether or not the bobbin 14 has filament 12 wound thereon (FIGS. 1 and 2). In this regard, the trigger sensor 18 operates to output a signal whenever a bobbin 12 is located in the path of the beam 24. As shown in FIGS. 1 and 2, the reset sensor beam 28 is directed at an angle preferably of about 45°, to a sensing point on bobbin 14 generally indicated at 34. As illustrated in FIG. 1, the reset sensor 20 operates by reversely reflecting the reset beam 28 off the filament 12 when there is filament 12 present at the sensing point 34. Thus, the reset sensor 20 operates to output a signal when filament 12 is present at the sensing point 34 on the bobbin 14. Referring to FIG. 1*a*, it is pointed out that the reset beam 28 reversely reflects off the rounded surface 36 of the filament 12. In this regard, the angle at Which the reset beam 28 is directed is not critical since the rounded configuration of the filament 16 provides a curved surface 36 that will reversely reflect the beam 32 at almost any angle. It is preferred, however, that the beam 28 be directed at an angle of substantially 45 degrees as this angle appears to produce the most accurate operation of the reset sensor 20. Referring now to FIG. 2, if there is no filament 12 present at the sensing point 34, the reset beam 28 deflects off the uncovered core 32 of the bobbin 12 away from the sensor 20, and the sensor does not output a signal. Thus, as the filament 12 gradually unwinds from the bobbin 14, it can be seen that the reset sensor 20 is able to detect when there is no longer any filament 12 present at the sensing point 34, and since the sensing point 34 is approximately midway along the length of core 32, there will be several turns of filament 12 left on the bobbin 14 when the filament 12 has become depleted at the sensing point 34.

The trigger sensor 18 and the reset sensor 20 are connected to the logic control module 22 which is in turn connected to the braiding machinery 16. The sensors 18 and 20 direct infra red light beams at the rotating bobbins 14, one by one, as they move in their orbital path beneath the sensors, and the logic control module 22 operates to measure the timing relationship between the output signals received from the sensors 18 and 20 by means of an internal timing circuit. The logic control module 22 further operates to output an instantaneous shut-down signal for halting the operation of the machinery 16 in response to certain timing relationships between the signals received. It will be understood that the logic control module comprises conventional microprocessor chip means, the details of which form no part of the instant invention.

Figure 3:
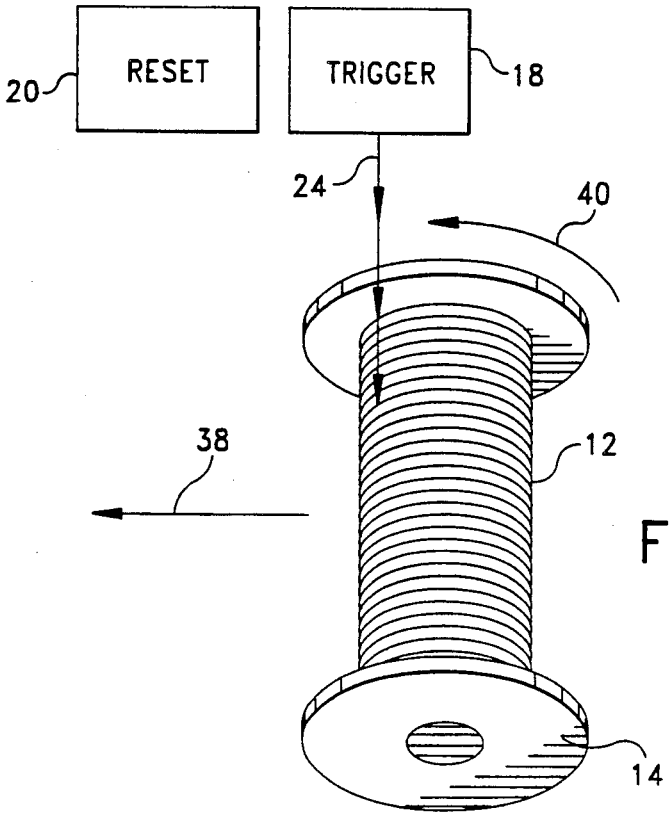
Figure 4:
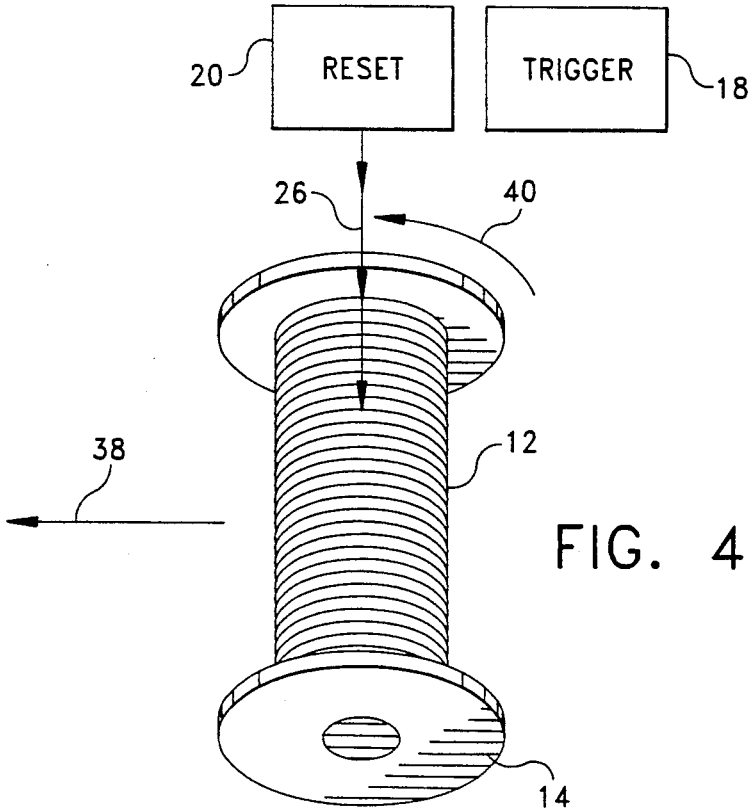

Referring to FIGS. 3 and 4, the relationship between the trigger sensor 18 and the reset sensor 20 is illustrated with regard to the orbital movement of the rotating bobbins 14 in the braiding machine 16, the arrow 38 representing the direction of orbital movement of the bobbins 14 in the braiding machine 16, and the arrow 40 representing the direction of rotation of the bobbins 14 around their own axis. The sensors 18 and 20 are spaced in relation to the orbital path of the bobbins 14, such that each bobbin 14 first passes under trigger beam 24, and then passes under the reset beam 28 (FIGS. 1*a*, 3 and 4) some milliseconds thereafter. As each bobbin 14 passes under the trigger beam 24 (FIG. 3), the sensor 18 outputs a signal to the control module 22 to start the timing circuit. The bobbin 14 thereafter passes under the reset beam 28 (FIG. 4). If the reset sensor 20 operates (indicating the presence of filament at the sensing point 34 on the bobbin) within a predetermined time, i.e. 20 milliseconds, the control module 22 cancels the timing function and the machine continues to operate. If, on the other hand, no filament 12 is detected, the reset sensor 20 does not operate, and the control module 22 outputs an instantaneous shut-down signal to halt the operation of the machine. More specifically, if there is filament 12 present at the sensing point 34, the reset sensor 20 will output a signal to the control module 22 stopping the timing circuit and the machine 16 continues to operate. If there is no filament 12 present, the beam 28 deflects away from the sensor (FIG. 2), no signal is outputted to the control module 22 to stop the timing circuit, and the control module 22 outputs a signal to halt the operation of the machinery 16. The timing circuit is adjusted to the speed and spacing of adjacent bobbins 14, and the spacing of the trigger 18 and reset 20 sensors. The time interval between adjacent bobbins 14 is accounted for in the timing circuit so that the sensors can operate to individually monitor each bobbin 14 as it passes under the sensors, i.e., the reset signal from the next succeeding bobbin will not come in time to cancel the timing circuit, where the next preceeding bobbin had no filament at point 34.

Although the sensor apparatus 10, as described, is specifically operable for monitoring the winding condition of bobbins 14 in a braiding machine, the basic principle of monitoring the winding condition of a bobbin by directing a photoelectric beam at an angle to a round filament wound thereon can be utilized in any type of machine, such as weaving machines, knitting machines, or any other machines, where supply bobbins 14 are utilized.

It is seen therefore, that the instant invention provides an effective photoelectric sensor for sensing the absence of filament on supply bobbins in machines. The sensor directs a photoelectric beam at an angle to the filament on the bobbin wherein reverse reflections of the beam are detected off the rounded surface of the filament when there is filament present at a sensing point on the bobbin. Due to the location of the sensing point on the bobbin, several turns of filament will be left on the bobbin when the filament has become depleted at the sensing point. Thus, it is seen that the operation of the machine can be effectively interrupted before the filament completely unwinds from the bobbin and breaks away therefrom to tangle in the machine. For these reasons, it is believed that the photoelectric sensor of the instant invention represents significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A photoelectric sensor for sensing a filament on a rotating bobbin, said bobbin having a core, said core having a longitudinal axis, said filament having a substantially round cross-section, said sensor comprising means for directing a beam of light along a predetermined line to a sensing point on the core of said bobbin, said line being disposed at an angle to the longitudinal axis of said core, said beam reflecting off the round surface of said filament back along said predetermined line when said filament is present at said sensing point, said beam deflecting off said core along a different line when said filament is not present at said sensing point, and means for detecting said beam when reflected back along said predetermined line.

2. The sensor of claim 1 further comprising output means for outputting an electronic signal when a reflection of said beam is detected.

3. In the sensor of claim 1, said bobbin having opposite ends, said sensing point being located intermediate the opposite ends of said bobbin.

4. The sensor of claim 1, wherein said angle is substantially 45 degrees.

5. The sensor of claim 1, said filament comprising wire.

6. In the sensor of claim 1, said beam of light comprising an infra-red beam of light.

7. A photoelectric sensor for sensing a filament on a rotating bobbin during its orbital movement in a braiding machine, said bobbin having a core, said core having a longitudinal axis, said filament having a substantially round cross-section, said sensor comprising:

means for directing a first beam of light along a first predetermined line to said bobbin, said first beam reflecting off said bobbin back along said first predetermined line, and means for detecting said first beam when reflected back along said first line;

means for directing a second beam of light along a second predetermined line to a sensing point on the core of said bobbin, said second line being disposed at an angle to the longitudinal axis of said core, said second beam reflecting off the round surface of said filament back along said second line when said filament is present at said sensing point, said second beam deflecting off said core along a third lien when said filament is not present at said sensing point, and means for detecting said second beam when reflected back along said predetermined line, said bobbin first passing through said first beam, and then passing through said second beam; and control means connected to said detecting means and said braiding machine, said control means including timing means whereby a timing function is started when a reflection of said first beam is detected and said timing function is ended when a reflection of said second beam is detected within a predetermined time, said control means outputting an electronic signal to halt operation of said braiding machine when a reflection of said second beam is not detected within said predetermined time.

8. The sensor of claim 7, wherein said angle is substantially 45 degrees.

9. In the sensor of claim 7, said filament comprising wire.

10. In the sensor of claim 7, said bobbin having opposite ends, said sensing point being located intermediate the opposite ends of said bobbin.

11. In the sensor of claim 7, said beam of light comprising an infra-red beam of light.

* * * * *